United States Patent [19]

Bowen et al.

[11] Patent Number: 4,772,890

[45] Date of Patent: Sep. 20, 1988

[54] MULTI-BAND PLANAR ANTENNA ARRAY

[75] Inventors: Douglas G. Bowen, Spanish Fork; Joseph Reese, Sandy; Michael A. Gerulat, Murray, all of Utah

[73] Assignee: Sperry Corporation, Blue Bell, Pa.

[21] Appl. No.: 708,587

[22] Filed: Mar. 5, 1985

[51] Int. Cl.[4] ..... H01Q 1/36; H01Q 21/06

[52] U.S. Cl. ..... 343/700 MS; 343/756; 343/819; 343/853

[58] Field of Search ..... 343/853, 846, 700 MS, 343/756, 708, 824–827, 829, 844, 835, 873, 795, 895, 893, 725, 833, 810, 812–820, 872, 909; 342/445–447

[56] References Cited

U.S. PATENT DOCUMENTS

| | | | |
|---|---|---|---|
| 2,994,871 | 8/1961 | Troost et al. | 343/853 |
| 3,273,158 | 9/1966 | Fouts et al. | 343/817 |
| 3,718,935 | 2/1973 | Ranghelli et al. | 343/846 |
| 3,854,140 | 12/1974 | Ranghelli et al. | 343/756 |
| 3,971,032 | 7/1976 | Munson et al. | 343/700 MS |
| 4,074,270 | 2/1978 | Kaloi | 343/853 |
| 4,309,706 | 1/1982 | Mosko | 343/895 |
| 4,367,474 | 1/1983 | Schaubert et al. | 343/700 MS |
| 4,387,377 | 6/1983 | Kandler | 343/756 |
| 4,401,988 | 8/1983 | Kaloi | 343/700 MS |
| 4,477,815 | 10/1984 | Brunner et al. | 343/756 |

FOREIGN PATENT DOCUMENTS

| | | | |
|---|---|---|---|
| 59607 | 4/1983 | Japan | 343/700 MS |

*Primary Examiner*—William L. Sikes
*Assistant Examiner*—Michael C. Wimer
*Attorney, Agent, or Firm*—John B. Sowell; L. J. Marhoefer; T. J. Scott

[57] ABSTRACT

A planar array of radiating elements which includes a plurality of radiating elements which are capable of operating upon electromagnetic signals of different frequency bands in a single planar array.

10 Claims, 2 Drawing Sheets

MULTI-BAND PLANAR ANTENNA ARRAY

BACKGROUND

1. Field of the Invention

This invention is directed to antenna arrays, in general, and to a planar antenna array which is capable of operating on a plurality of different frequency bands with superior operating characteristics, in particular.

2. Prior Art

There are many types of antennas and arrays which are known in the art. These antennae include many structural configurations. Within the context of the instant invention, the most pertinent antenna arrays which are known in the art are, typically, the parabolic dish antenna array and a planar antenna array. In the environment and configuration contemplated herein, these antennae have the dimensions of approximately six to seven feet in diameter (for the parabolic dish) and about seven feet square (for the planar array). In the known antennae configuration, each antenna is usually arranged to be tuned to operate upon (i.e. transmit or receive) a single frequency. This is usually achieved by placing the transmitter or radiating element (in a parabolic dish unit) at the center or focal point of the dish antenna. In this case, a high degree of accuracy and a very small degree of tolerance is permitted in producing the device.

Conversely, in the planar array which is known in the art, all of the radiating elements in the array are of substantially the same size and configuration in order to achieve an accurate signal configuration.

In an attempt to provide additional operational capability, some known parabolic and/or planar arrays utilize additional elements which are slightly modified so as to provide additional frequency capabilities. However, in the known planar arrays, the radiating elements are designed to produce frequencies which are within the same band, i.e. C, X or Ku. In the parabolic dish arrangement, the additional frequency capability is achieved by using two radiating elements which are slightly off the focal point of the dish and placed on some other compromise arrangement. Obviously, this produces a less than ideal apparatus without significantly improving the apparatus itself or its operation.

For a description of one type of planar array antenna, reference is made to the IEEE Transactions On Antennas And Propagation, Vol. AP29, No. 1, January 1981, pages 25–37, entitled "MICROSTRIP ARRAY TECHNOLOGY" by R. J. Mailloux, et al.

Another reference is an article by K. C. Gupta entitled "RECENT ADVANCES IN MICROSTRIP ANTENNAS", which appeared in the "Microwave Journal" October 1984 issue on pages 50–66.

SUMMARY OF THE INVENTION

The instant invention is directed to a planar antenna array which permits an antenna to be configured to produce highly accurate signals from multiple frequency bands with a high degree of accuracy, improved operating characteristics and relatively light weight. The antenna is capable of selectively producing circular polarization of either right or left hand rotation.

DESCRIPTION OF PREFERRED EMBODIMENTS OF THE INSTANT INVENTION

Figure 1:
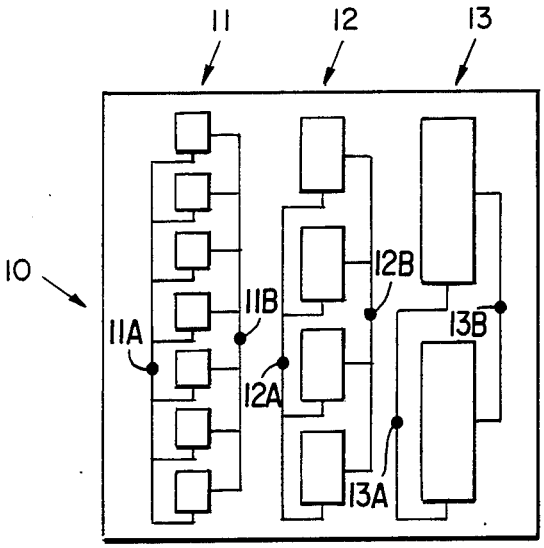
FIG. 1 is a plan view of the array of the instant invention.

Referring now to FIG. 1, there is shown a schematic plan view representation of the instant invention. This view comprises an array 10 which is formed in any suitable arrangement wherein a plurality of radiating elements 11, 12 and 13 are provided. It is shown that the radiating elements are of three categories which have substantially different sizes and/or configurations. It is clear that elements 11 are relatively small elements 11. The elements in array 10 are shown to be substantially square. However, these elements can be round or some other suitable shape in the control of patterns characteristics. These elements are arranged to operate on the Ku frequency band which comprises frequencies in the range of 14.0 to 15.5 GHz.

In similar manner, a plurality of additional radiating elements 12 is also disposed as part of array 10. The radiating elements 12 are somewhat larger than the elements 11 and are selected to produce the X band of frequencies which are in the range of 9.5 to 10.5 GHz.

In like manner, the radiating elements 13 are also disposed as part of array 10. Again, radiating elements 13 are larger than radiating elements 12 and are appropriately configured to produce signals in the C frequency band which has the range of 4.0 to 6.0 GHz.

Each of the elements 11, 12 and 13 is disposed on the array 10 which may comprise a single antenna array in and of itself or, within the contemplation of this invention, each of the arrays 10 may represent a sub-array. That is, a plurality of arrays 10 may be produced in a suitable mass produced or mass manufactured technique and then assembled on a suitable support structure to produce the actual antenna array (see FIG. 9). In typical arrangement, the array 10 is on the order of 8 to 10 inches square while the actual antenna array 100 is on the order of approximately 7 feet square.

In addition, it is noted that all of the radiating elements 11, 12 or 13 in the respective arrays are connected together by suitable connector elements. In the particular embodiment shown in FIG. 1, the connector elements are connected to the same side of each of the respective radiating elements. The purpose for this connection is described hereinafter. It is also noted that each of the connector elements is connected to a suitable terminal 11A, 11B, 12A, 12B, 13A and/or 13B. These terminals are understood to be connected to appropriate connectors or "plumbing" which is used to connect the source (not shown) to the respective radiating elements. The particular type of plumbing, as it is known in the art, is placed beneath the array, and is not shown in this embodiment in order to preserve clarity. However, the plumbing arrangements are well known in the art and comprise appropriate waveguide or similar types of elements in order to supply the appropriate signal to the array device as shown in FIG. 3.

Figure 2:
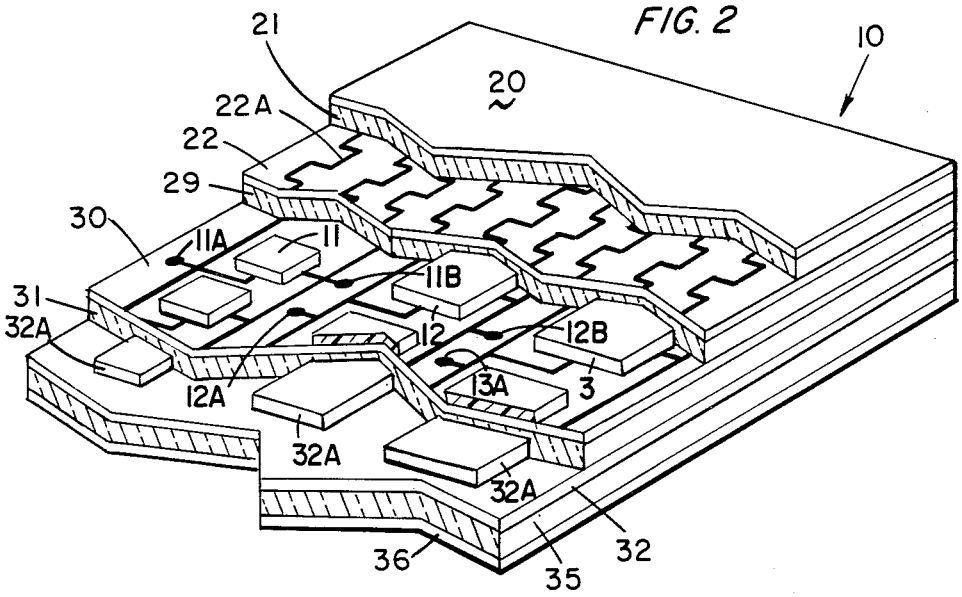
FIG. 2 is a broken away, perspective view of the antenna array of the instant invention.

Referring now to FIG. 2, there is shown a partially broken away sectional view of one arrangement of an array 10 shown in FIG. 1. In the array shown in FIG. 2, the array comprises a plurality of layers or elements.

Figure 3:
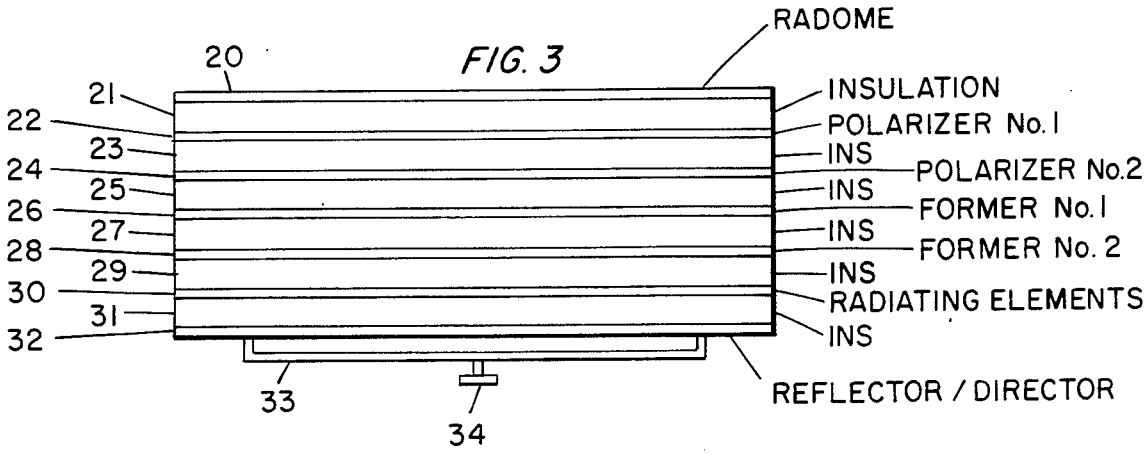
FIG. 3 is a side view of the antenna array of the instant invention.

In addition, reference is made to FIG. 3 which shows a similar arrangement in cross-sectional view. The components in FIGS. 2 and 3 which are similar to each other bear similar reference numerals. It should be noted that the arrangement shown in FIG. 3 is somewhat more elaborate than the device shown in FIG. 2.

In any event, each of the arrays includes a top layer 20 which can be considered to be a radome or the like. Typically, this layer is formed of a material such as fiberglass or the like which will not interfere with the operation of the antenna element. The radome 20 is used to provide protection and/or support to the antenna array apparatus. The radome 20 is supported by an insulating layer 21 which can be formed of any suitable type of insulating material such as, in a preferred embodiment, a closed cell polystyrene material. In some cases, layers 20 and 21 may be formed together as a unitary element.

The next layer in FIGS. 2 and 3 is a polarizing layer 22. This layer is formed of a suitable support material, such as fiberglass or the like, on which is developed, in a suitable fashion, a polarizing layer array 22A which comprises a periodic "zig-zag-line" or a plurality of such lines thereacross. These lines are periodic and, typically, give the appearance of a square wave or toothed line. The configuration, placement and spatial relationship of these lines is a function of the type of electro-magnetic signal which is to be produced by the antenna. This type of element or board is known in the art and is fabricated in a suitable fashion such as by electrodeposition, etching, machining, silkscreening or the like. The zig-zag (or meander) line 22A is, generally, formed of metal but is not connected to any source but takes the form of a passive element. By properly installing polarizer layer 22, a circular polarization is imparted to the signal which is passing through the radiation array. See for example, U.S. Pat. No. 4,387,377 to Kandler; U.S. Pat. No. 3,854,140 to Ranghelli et al; or U.S. Pat. No. 4,477,815 to Brunner et al.

Referring, particularly, to FIG. 3, a second polarizer layer 24 is also shown. Polarizer layer 24 is substantially identical to polarizer layer 22 in terms of the construction thereof. Polarizer layer 24 has the zig-zag lines disposed thereon substantially parallel to the zig-zag lines 22A on layer 22. In addition, layer 24 may be arranged with the polarizer lines arranged transverse to the polarizer lines 22A. As shown in FIG. 3, an insulating layer 23 is also disposed between polarizer layers 22 and 24. (For convenience, the second polarizer layer 24 and the related insulating layer 23 are omitted from the showing in FIG. 2.)

Also shown in FIG. 3 are two signal forming layers 26 and 28 which are mounted on insulating layers 25 and 27, respectively. The forming layers 26 and 28 are omitted from the showing in FIG. 2 for convenience. In point of fact, these layers may be omitted in some types of antenna construction.

Typically, forming layers 26 and 28 include patterns formed and positioned thereon relative to the radiating elements (described hereinafter) to cause a signal produced by the radiating elements to be formed or shaped in terms of radiation. Thus, a more carefully directed or focused radiation signal is produced by the respective radiating elements. This operation is typical of many YAGI antennae.

Referring concurrently to FIGS. 2 and 3, there is shown another insulating layer 29 which is disposed relative to the layer 30 which includes the radiating elements. These radiating elements comprise the radiating elements 11, 12 and 13 as shown in FIG. 1. Again, these radiating elements are joined together by the appropriate conductors which are connected to the appropriate sources as shown and described relative to FIG. 1. These elements are the elements which produce the actual radiation signals of the antenna.

In each of the devices shown in FIGS. 2 and 3, another insulating layer 31 is disposed beneath the radiating element layer 30 and a reflector or director layer 32 is disposed adjacent thereto. In some cases, the reflector/director layer can be a single sheet of reflective material which is arranged to reflect the electromagnetic wave signal produced by the radiating elements back through the elements and out through the radome. Thus, a single directional antenna is produced. Of course, the insulating layer 31 is arranged so that the reflector layer 32 is disposed at the appropriate distance such that the signals produced by the radiating elements 11, 12 and 13 are reflected back therethrough in an additive fashion whereby little or no loss is encountered due to out-of-phase or subtractive signal operation.

In the embodiment shown in FIG. 2, the reflector layer 32 comprises a plurality of elements which are configured in a substantially similar arrangement to the radiating elements on layer 30. That is, a reflective (otherwise passive) layer 32 with a plurality of reflective elements 32A is disposed immediately beneath the radiating elements 11, 12 and 13 on layer 30. This arrangement also has the advantage of providing wider bandwidth and further directionality to the antenna array. As shown in FIG. 2, an additional insulating layer 35 and a further reflecting and/or radome layer 36 can be incorporated.

In either case, the suitable "plumbing" layer 33 is arranged beneath the antenna array and is connected by suitable means to the energy source 34. This source can be any appropriate source such as but not limited to a microwave signal generating device. Source 34 can represent a single source for array 10 or a side view of one of the sources for each of the separate groups of elements 11, 12 or 13 shown in FIG. 1.

Figure 4:
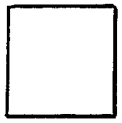
FIGS. 4, 5 and 6 are schematic representations of different types of radiating elements used in the antenna of the instant invention.
Figure 5:
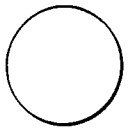
Figure 6:
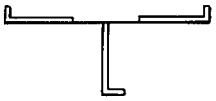

Referring now to FIGS. 4, 5 and 6, there are shown schematic representations of the radiating elements 11, 12 and 13 which can be formed on layer 30 of the arrays shown in FIGS. 1, 2 or 3. In particular, FIG. 4 shows a rectilinear radiating element. Typically, in the rectilinear element, a square configuration is utilized. A square configuration permits uniform radiation throughout the element.

As shown in FIG. 5, the radiating element can be a circular (or annular) configuration. Again, this type of configuration will assure a uniform signal generation capability.

FIG. 6 is a schematic representation of a dipole radiating element. Other types of configuration of the dipole arrangement can be provided.

Figure 7:
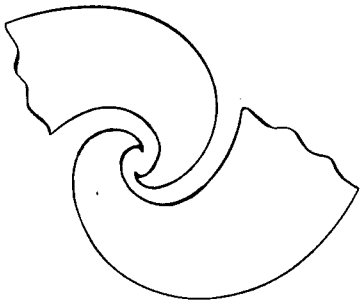
FIG. 7 is a schematic representation of another embodiment of the instant invention.

Referring now to FIG. 7, there is shown an alternative configuration to the radiating element construction.

In this case, a spiral dipole configuration of the types suggested by U.S. Pat. No. 4,309,706 to Mosko is provided. It is seen that the dipole arrangement is provided between two interleaved spiral conductors which spiral outwardly relative to themselves and to each other. This spiral configuration has the effect of producing a circular polarization signal operation by itself.

Figure 8:
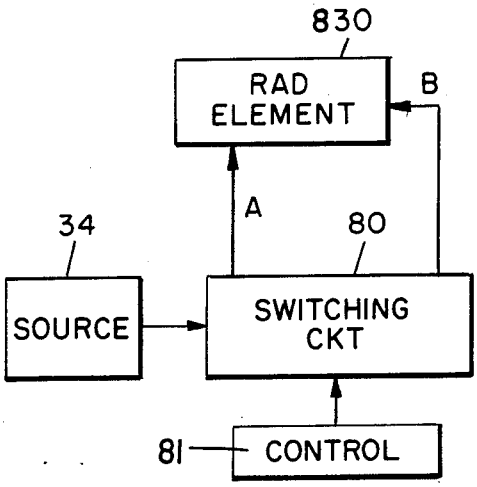
FIG. 8 is a schematic representation of an embodiment of the instant invention which permits selectable circular polarization.

Referring now to FIG. 8, there is shown a schematic representation of a radiating element 830 which is connected to the source 34 via the switching circuit 80. The radiating element 830 can be considered to be any of the radiating elements shown in FIGS. 4, 5 or 6 and disposed on radiating element layer 30 in FIGS. 2 or 3. Source 34 is equivalent to the source 34 shown schematically in FIG. 3. The switching circuit 80 can be of any suitable circuitry which is used to selectively pass a signal from source 34 to the radiating element 830. In fact, switching circuit 80 can be any kind of RF switching circuit and can be included on a portion of the antenna array or it can be produced as a separate component which is included in part of the "plumbing" 33 (see FIG. 3).

In operation, the source 34 applies a suitable signal to the system in the typical fashion. This signal is applied to the radiating elements 30 as shown or suggested in FIGS. 2 and 3. However, in the embodiment shown in FIG. 8, the signal from source 34 is first supplied to switching circuit 80. Depending upon control signals which are supplied to switching circuit 80 either from an external control source 81 or as a function of the signals supplied from source 34, the electromagnetic signal to be radiated is supplied to one side or the other of the radiating elements of radiating layer 30. That is, the signal is supplied alone lines A or along line B to the radiating elements 11, 12 or 13 of radiating layer 30. Line A and B are shown relative to one of the radiating elements 12 in FIG. 1. By controlling the input connection or configuration of the circuit, a different arrangement of the E and H vectors or components of the signal are applied by the radiating element in a different fashion. In this regard, the polarizing layer 22 and/or 24 tends to provide circular rotation to the signal produced by the radiating elements on layer 30. By proper selection of the polarizer layers 22 and 24, circular polarization can be achieved. In particular, left hand or right hand circular polarization can be achieved as a result of supplying the input signal to the radiating element alone line A or B.

It will thus be seen that this invention permits the antenna array 10 to produce signals of different frequency bands (for example, X, C and Ku), it permits selective frequency-hopping and selectively produces left-hand or right-hand circular polarization, if desired. Thus, this antenna has significant capabilities in terms of covert signal operation, especially those operations wherein it is desirable to avoid detection and/or jamming of the signal by a competitor.

Figure 9:
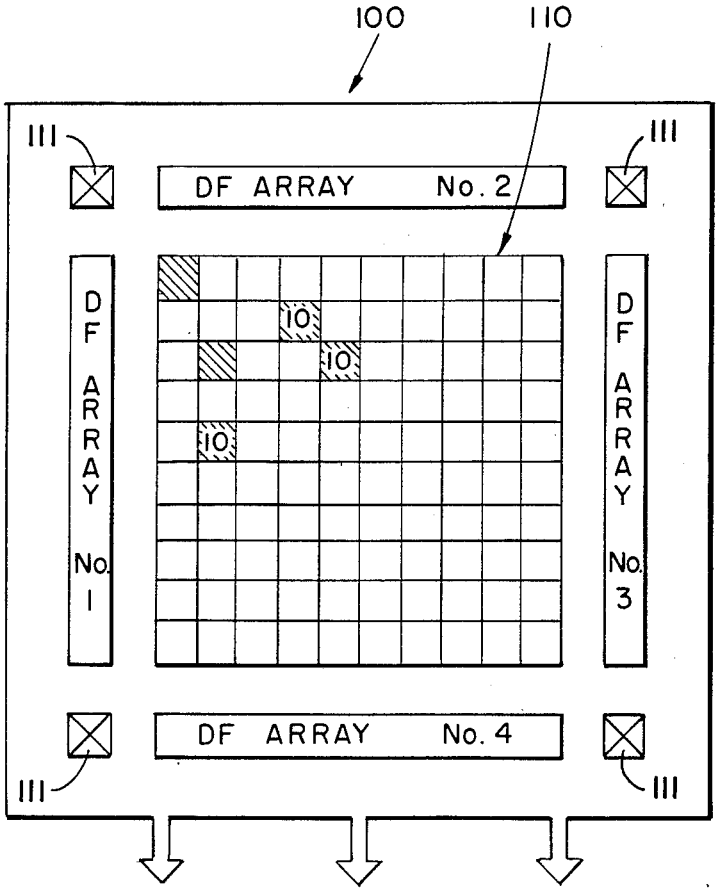
FIG. 9 is a schematic representation of a typical planar antenna array in accordance with the instant invention.

Referring now to FIG. 9, there is shown a typical antenna using the teachings of the instant invention. In particular, an antenna array 100 is arranged in a planar fashion. As noted, the planar arrangement may be on the order of 7 feet square. The antenna includes a main array 110 which is comprised of a plurality of sub-arrays 10 such as are shown in FIG. 1. The sub-arrays are arranged on the planar array support and interconnected by means of the appropriate plumbing such as shown in FIG. 3 in order to produce output signals of the frequency bands Ku, C and X.

In the embodiment shown in FIG. 9, direction finding (DF) arrays 1 through 4 are also disposed on the antenna plane. In this arrangement the DF arrays are distributed around the perimeter of the antenna. It is clear that through appropriate construction, plumbing and so forth that the direction finding arrays can be combined or distributed along the perimeter in any fashion deemed desirable. In addition, diplexer locations 111 are suggested in the respective corners of the planar array. However, any suitable arrangement of the diplexers is permissible, including behind the array.

Thus, there is shown and described a preferred embodiment of a planar array antenna which has the capability of operating on a multi-band frequency arrangement. This antenna is not limited to a single frequency or to a single frequency band. The antenna is capable of selective circular polarization of the signals on which it operates. The polarization is selectively interchangeable between left hand or right hand circular polarization.

The antenna can be fabricated in accordance with any number of techniques including microstrip array (for example, see Japanese Pat. No. 58-59607 A), log-periodic array, or the like. The antenna can be fabricated by a suitable plating, etching, silk-screening or other known fabrication techniques. It has been determined that this planar array will provide substantial gain to each of the frequency bands which are produced by this array. This gain, more importantly, is improved relative to a single frequency band parabolic array. Likewise, with this antenna array the DF array gain is improved and the side lobe attenuation is substantially improved, as well. As noted, all of these improvements are achieved on an antenna array which operates on multiple, in this case at least three, different frequency bands (as compared to the similar operation in the existing antenna arrays which operate only on single bands). Clearly, in addition to the improved operation, it is highly desirable to have a single antenna array which is of approximately the same size and substantially less weight than a single frequency band antenna which is known in the art. The savings in weight and space (not to mention expense) are significant when only one antenna unit is required instead of three.

The antenna has been described in sufficient detail to permit those skilled in the art to understand the teaching thereof. In addition, certain specific characteristics have been recited. These characteristics are intended to be illustrative of the invention and are not intended to be limitative. Those skilled in the art will possibly conceive modifications and variations to the teachings made above. For example, in certain arrangements it is not necessary to utilize extensive layering. That is, where selective polarization is achieved by means of the selective application of control signals the polarizing layer may be omitted. In the case of linear or log periodic structures, of course, the specific layering techniques are desirable. any such modifications or derivations which fall within the purview of this description are intended to be included herein as well. Thus, the scope of the teaching is limited only by the claims appended hereto.

What is claimed is:

1. An antenna comprising, a planar antenna (100) including a main array (110) comprised of a plurality of coplanar antenna sub-arrays (10), each of said antenna sub-arrays comprises a multi-layer structure which includes:

a radiating layer (30) including a plurality of at least three groups of radiating elements (11, 12, 13) which are respectively capable of operating with and radiating electromagnetic signals of different frequency bands;

the radiating elements in each group are substantially identical to each other in size and configuration;

the radiating elements in each group are substantially different in size from the radiating elements in the other groups;

the radiating elements in different groups are operable for radiating electromagnetic signals of different frequency bands wherein the frequency bands differ by approximately 50% of the mid-frequency band and have a bandwidth of approximately 10%–20% of the mid-frequency;

said different frequency bands comprise the X band, the C band and the Ku band;

first and second conductors related to each of said groups of radiating elements and disposed at said radiating layer;

said first conductor related to each group of radiating elements connected to a first position on each of said radiating elements in a group of radiating elements capable of operating at the same frequency band;

said second conductor related to each group of radiating elements connected to a second position on each of said radiating elements in a group of radiating elements capable of operating at the same frequency band;

source means (34) for supplying energy to said radiating elements via the respective first and second conductors related to a group of radiating elements to produce the electromagnetic signals radiated thereby;

control means for controlling the selective connection of said source means to different positions on said radiating elements in order to achieve either left-hand-circular polarization or right-hand-circular polarization;

a reflecting layer (32) of metal for directing the electromagnetic signals radiated by said radiating elements included at said radiating layer;

a first electrically insulating layer (31) interposed between said radiating layer and said reflecting layer;

a polarizing layer (22) disposed over said radiating layer and including a pattern (22A) of metal thereon for influencing the polarization of the electromagnetic signals radiated by said radiating elements of said radiating layer;

a signal forming layer (26) of metal disposed over said polarizing layer;

a second electrically insulating layer (29) interposed between said signal forming layer and said radiating layer; and a third electrically insulating layer (25) interposed between said polarizing layer and said signal forming layer, each said insulating layer is formed of a closed-cell polystrene material.

2. The antenna recited in claim 1 wherein, said radiating elements are rectilinear in shape.

3. The antenna recited in claim 1 wherein, said radiating elements are dipoles.

4. The antenna recited in claim 1 wherein, said multilayer structure further includes:

a radome layer of non-metallic material disposed over said structure as a protective layer.

5. The antenna recited in claim 1 wherein, said polarizing layer includes a periodic zig-zag strip of metal.

6. The antenna recited in claim 1 wherein, said frequency bands are the C band, X band and Ku band with frequency ranges of 4.0–6.0 GHz, 9.5–10.5 GHz, and 14.0–15.5 GHz, respectively.

7. The antenna recited in claim 3 wherein, said radiating elements are formed from a pair of interleaved spiral conductors.

8. The antenna recited in claim 1 wherein, said antenna elements are formed by a conventional microstrip process.

9. The antenna recited in claim 1 including, direction finding antenna means disposed at said planar antenna to provide a direction finding and tracking capability for said antenna.

10. The antenna recited in claim 1 wherein, said mid-band frequencies are approximately 5.0 GHz; 10.0 GHz and 14.75 GHz respectively.

* * * * *